United States Patent [19]

Segafredo

[11] 4,269,123

[45] May 26, 1981

[54] SAFETY DEVICE FOR A ROCKER OF SHEAVES SUPPORTING AN OVERHEAD CABLE

[75] Inventor: André Segafredo, Seyssinet, France

[73] Assignee: Pomagalski S.A., France

[21] Appl. No.: 5,087

[22] Filed: Jan. 22, 1979

[30] Foreign Application Priority Data

Feb. 1, 1978 [FR] France ..... 78 03304

[51] Int. Cl.[3] ..... B61B 12/00

[52] U.S. Cl. ..... 104/178; 104/179; 200/61.18; 254/394

[58] Field of Search ..... 104/179, 178, 173 R; 254/173 R, 173 B, 175.3, 175.5

[56] References Cited

U.S. PATENT DOCUMENTS 4,019,002 4/1977 Kunczynski ..... 104/178

FOREIGN PATENT DOCUMENTS 361827 6/1962 Fed. Rep. of Germany ..... 104/179

1423648 11/1965 France ..... 104/178

*Primary Examiner*—Richard A. Bertsch

*Attorney, Agent, or Firm*—Stevens, Davis, Miller & Mosher

[57] ABSTRACT

The safety device detects the derailment of a cable and/or the loss of one or more sheaves of a rocker supporting the cable. It includes a pivotable cross-piece which extends over the side-plates of the rocker and is prolonged laterally to form a component for catching the derailed cable. An appendix can form a temporary support for the cable when a sheave 10, 12 is lost. The pivoting of a crosspiece cuts the safety-line conductor to signal a problem condition.

The device can be applied to a gondola lift.

3 Claims, 2 Drawing Figures

SAFETY DEVICE FOR A ROCKER OF SHEAVES SUPPORTING AN OVERHEAD CABLE

The invention relates to a safety device for a rocker of sheaves supporting an overhead cable and with side-plates articulated on a support spindle including a means of catching the derailed cable fitted on the side of the rocker and a derailment detector actioned by the falling of the cable on to the means of catching.

French Pat. No. 1,423.648 describes a device of the type mentioned for catching and signalling the derailment of the cable which derives directly from the movement of the cable the energy interrupting the safety-line of a gondola lift or chairlift. This safety is insufficient and inoperative in the case of the loss of a sheave or a rocker, for instance through the breaking of a support spindle.

The present invention has for object the remedying of this disadvantage, and to permit the execution of a simple and strong device palliating a derailment of the cable and the failure of the elements on which the cable bears.

The safety device according to the invention is distinguished by a cross-piece stretching transversally to the side-plates of the rocker to interfere with the trajectory of excessive movement of the side-plates and projecting laterally to form the said catching means.

The cross-piece in the form of a rigid bar constitutes a stop limiting the movement of the rocker in order to retain this in a position near to its normal position, and to permit provisional running of the gondola lift without risk of accident when a sheave is lost.

The cross-piece is advantageously mounted so as to pivot to a limited extent in order to action a shear cutting of the safety-line of the gondola lift in the case of the derailment of the cable or an excessive pivoting of the rocker. It carries in addition an appendix able to carry the cable temporarily, until the gondola lift is stopped, on the loss of a sheave or rocker.

It is easily seen that the safety device signals any failure of the elements supporting the cable, and palliates temporarily such failures so as to avoid any accident. The system is simple and strong.

An application of the invention, given as an example, is described below, referring to the attached drawing, in which.

Figure 1:
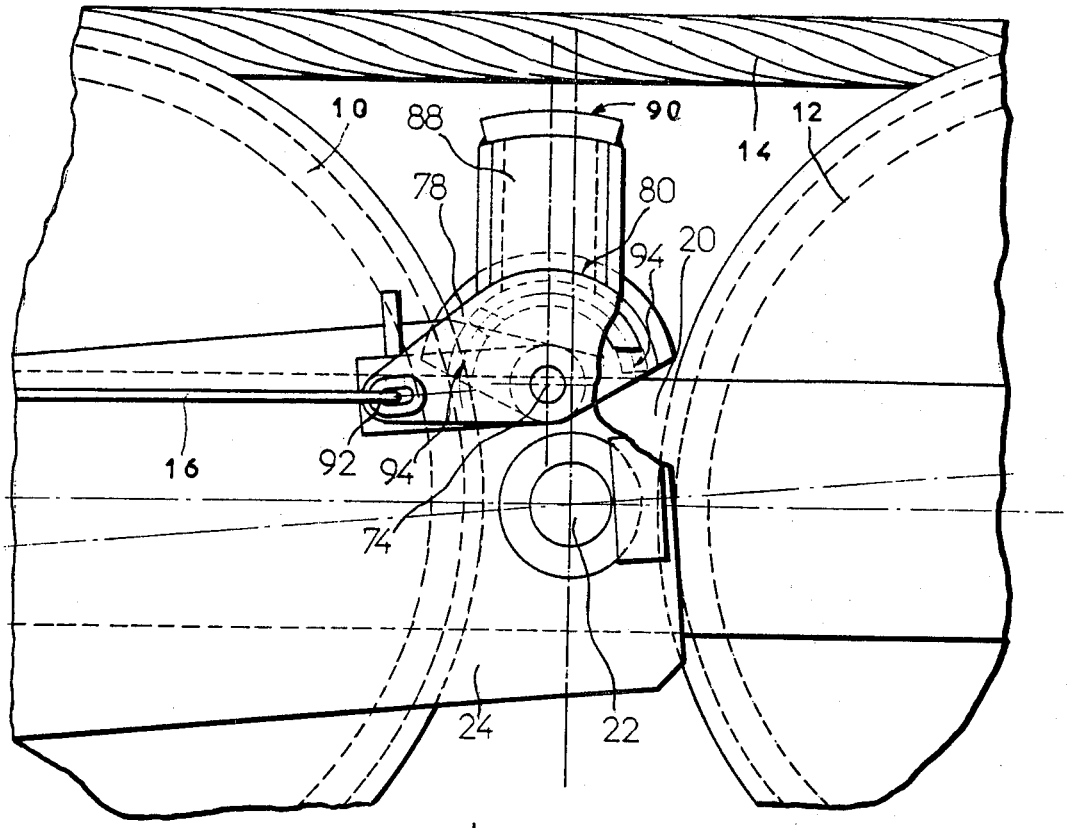
FIG. 1 is a view in elevation, partly cut away, of a safety device in accordance with the invention.
Figure 2:
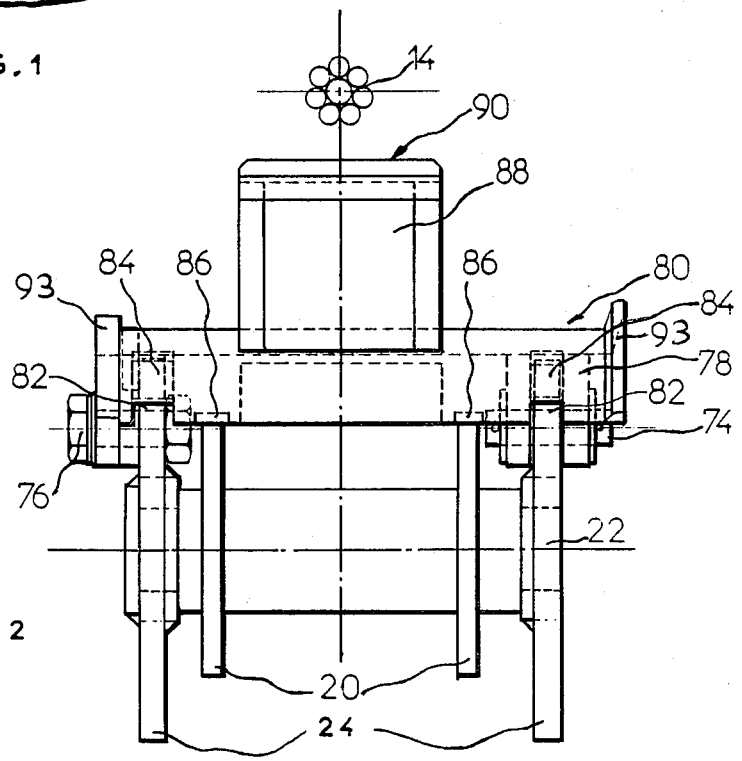
FIG. 2 is a side view of the device shown in FIG. 1.

In these figures, two sheaves, 10, 12, support the cable 14 of an overhead cable transport installation, more particularly a gondola lift or chairlift. The sheaves 10, 12 are mounted so as to rotate on the side-plates 20 to form an element of a rocker mounted so as to rotate on a spindle 22 carried by the main side-plates 24. Such rockers for supporting or holding-down the cable are well known to experts, and can include any nunber of elements.

On the main side-plates 24 is mounted pivotally by means of spindles 74, 76 a cross-piece 78, the pivoting of which is limited and which has a semi-cylindrical external upper surface 80. The upper edges of the side-plates 24 penetrate grooves 84 in the lower surface of the cross-piece 78 of sufficient depth to allow the said restricted pivoting. The cross-piece 78 extends over the whole width of the rocker, projecting laterally from this, and is mounted between the sheaves 10, 12 appreciably above the articulation spindle 22 of the rocker element. The cross-piece 78 covers the side-plates 20 and opposite to each side-plate 20 has a small groove 86 which allows a restricted movement of the side-plates 20 in relation to the cross-piece 78. The central part of cross-piece 78 carries an appendix 88 with a rounded end surface 90 extending near and under the cable 14 in the normal working position. The width of the appendix 88 corresponds appreciably with that of the sheaves 10, 12. The cross-piece 78 is equipped with a shear 92 with a hole for the passing of the safety-line conductor 16 and it has at its ends one or more raised edges 93 to hold the derailed cable.

In the normal operating position, as shown in the figures, there is a slight play 94 between the side-plates 20 and the grooves 86 which allows a restricted movement of the side-plates 20 in relation to the cross-piece 78. This cross-piece 78 does not intervene therefore during normal operation of the gondola lift. It detects the falling of the cable 14 in case of derailment. The cable 14 falls on the rounded surface 80 of the cross-piece 78 and rotates it under the effect of friction, thus actioning the shear 92, which cuts the conductor 16 and causes the stopping of the lift. The force necessary for the cutting of the conductor 16 is derived from the movement of the cable 14. The width of the cross-piece 78 and its raised edges 93 prevent the fall of the cable 14 to the outside, and the cross-piece 78 forms a cable-catching component which allows the passing of the grips attached to the cable during the time necessary for the stopping of the installation. The cross-piece 78 also ensured the limiting of the pivoting of the rocker with side-plates 20 in case of the loss of a sheave 10, 12. In this case the side-plates 20 come up against the grooves 86 in the cross-piece 78 retained by the main side-plates 24 abutting against the grooves 84. The appendix 88 forms a temporary support for the cable 14 in case of the breaking of the spindle 22 and the loss of the rocker or in the case of loss of a sheave 10, 12. The cable 14 then runs on the surface 90, and causes the pivoting of the cross-piece 78 which cuts the conducteur 16. The surface 90 with a rounded-off entrance also allows the passing of a grip fixed on to the cable 14.

It is clear that the cross-piece 78 can action a safety switch or any other signalling device.

I claim:

1. A safety device for a sheave rocker assembly, said assembly comprising: a pair of side plates articulated on a support spindle and supporting between them on opposite sides of said spindle two sheaves for supporting an overhead cable, said safety device comprising a crosspiece pivotably mounted between said sheaves above said spindle and arranged traversely of said side plates for equally engaging with said side plates upon their excess rocking movement in either of two rotating directions, a portion of said crosspiece projecting laterally of said side plates to form an area for catching a cable derailling from said sheaves, said crosspiece pivoting in response to movement of a derailed cable thereon to actuate a derailment detector, said crosspiece further including a projection having a bearing surface situated near and under a cable supported by the sheaves for supporting the cable upon loss of one or both of the sheaves and pivoting said crosspiece in response to movement of said cable thereon to actuate said detector.

2. A safety device in accordance with claim 1, wherein said derailment detector comprises a safety line and a means of cutting the line, said cutting means being operative upon the pivoting of said crosspiece.

3. A safety device in accordance with claim 1, wherein the bearing surface and the catching crosspiece portion are shaped so as to allow a temporary continuation of the longitudinal movement of the cable upon loss of a sheave or derailment of said cable.

* * * * *